US008588442B2

(12) United States Patent
Schmitt et al.

(10) Patent No.: US 8,588,442 B2
(45) Date of Patent: Nov. 19, 2013

(54) METHOD FOR ADJUSTING A HEARING DEVICE

(75) Inventors: Nicola Schmitt, Stafa (CH); Harald Krueger, Affoltern am Albis (CH)

(73) Assignee: Phonak AG, Stafa (CH)

( * ) Notice: Subject to any disclaimer, the term of this patent is extended or adjusted under 35 U.S.C. 154(b) by 65 days.

(21) Appl. No.: 13/130,782

(22) PCT Filed: Nov. 25, 2008

(86) PCT No.: PCT/EP2008/066107

§ 371 (c)(1),
(2), (4) Date: May 24, 2011

(87) PCT Pub. No.: WO2009/022021

PCT Pub. Date: Feb. 19, 2009

(65) Prior Publication Data

US 2011/0243355 A1 Oct. 6, 2011

(51) Int. Cl.
*H04R 25/00* (2006.01)

(52) U.S. Cl.
USPC ..... 381/314; 381/312

(58) Field of Classification Search
USPC ..... 381/312–331, 60
See application file for complete search history.

(56) References Cited

U.S. PATENT DOCUMENTS

| | | | | |
|---|---|---|---|---|
| 2002/0037087 | A1* | 3/2002 | Allegro et al. | 381/317 |
| 2009/0154741 | A1* | 6/2009 | Woods et al. | 381/312 |

FOREIGN PATENT DOCUMENTS

| | | | |
|---|---|---|---|
| DE | 10142347 | C1 | 10/2002 |
| EP | 0269680 | A1 | 6/1988 |
| EP | 0335542 | A2 | 10/1989 |
| EP | 0503536 | A2 | 9/1992 |
| EP | 1256258 | B1 | 11/2002 |
| EP | 1367857 | A1 | 12/2003 |
| EP | 1414271 | A2 | 4/2004 |
| FR | 2664494 | A1 | 1/1992 |
| WO | 87/07464 | A1 | 12/1987 |
| WO | 01/54456 | A1 | 7/2001 |
| WO | 01/97564 | A2 | 12/2001 |
| WO | 2007/045276 | A1 | 4/2007 |

OTHER PUBLICATIONS

International Search Report for PCT/EP2008/066107 dated Feb. 23, 2009.
Written Opinion for PCT/EP2008/066107 dated Feb. 23, 2009.

* cited by examiner

*Primary Examiner* — Duc Nguyen
*Assistant Examiner* — Matthew Eason
(74) *Attorney, Agent, or Firm* — Pearne & Gordon LLP

(57) ABSTRACT

A method for adjusting a hearing device with a transfer function describing input/output behavior of the hearing device is presented. A sound signal is recorded by an input transducer of the hearing device. At least one of the sound signal and characteristics of the sound signal are stored in a memory unit. A data base is provided having at least media samples. The at least one of the sound signal and its characteristics are compared with at least some of the media samples or characteristics thereof, respectively, to obtain a qualitative measure for at least some of the media samples with respect to the sound signal or its characteristics. The media sample having the best qualitative measure is selected and the transfer function is adjusted on the basis of the selected media sample.

20 Claims, 1 Drawing Sheet

METHOD FOR ADJUSTING A HEARING DEVICE

Figure 1:
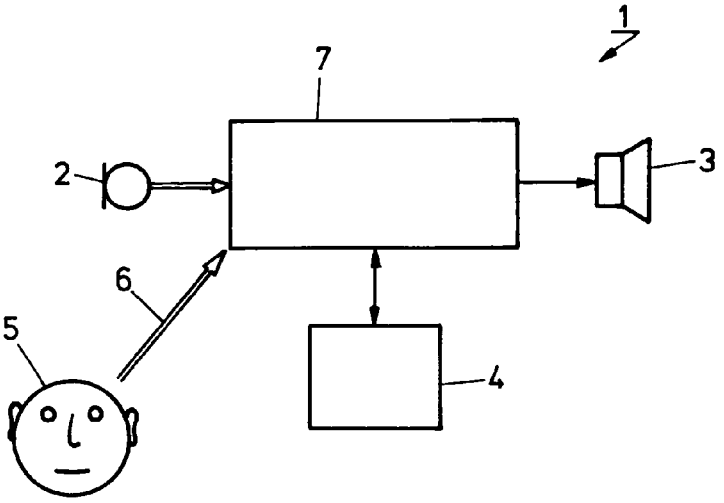

The present invention is related to a method for adjusting a hearing device as well as to a hearing system comprising a hearing device.

Fitting or adjusting a hearing device to individual needs usually requires several fitting sessions. After using the hearing device for some time in real life, the hearing device user returns to the fitter to get the hearing device readjusted (or fine-tuned). Adjustment and readjustment of a hearing device is usually performed using a standard personal computer (PC) with software provided by the hearing device manufacturer.

A first known method for adjusting a hearing device is disclosed by EP-0 269 680. The known method teaches to present pre-recorded environment sounds to the hearing device user with inserted hearing device during a fitting session. The sounds are created by multiple speakers.

Furthermore, FR-2 664 494 discloses an audiometry booth with video screens for presenting pre-recorded audiovisual scenes corresponding to sound conditions the hearing device user may find himself in.

WO 2001/97 564 discloses a fitting apparatus which comprises a multi-media database. The fitting apparatus has an online connection to a central computer comprising numerous media samples. The media samples, which are selected for the fitting session, are downloaded to the fitting device, whereas the media samples to be downloaded are determined by interviewing the hearing device user.

EP-0 503 536 discloses recording standard listening situations that are analyzed after being recorded. The analysis is directed to the frequency and level distribution as well as to the maximum levels contained in the recorded listening situations. The result of this analysis enables to determine typical samples and reduce the number of samples, which have to be taken into account during the fitting session.

EP-0 335 542 discloses a hearing device comprising data logging. User-selected and environmentally triggered events are stored in a memory. A readjustment is performed as appropriate in view of the data stored in the memory. EP-1 414 271 teaches to initiate data logging by a user event.

EP-1 256 258 discloses to use data logging before the first use of a hearing device in order to more reliably estimate the actual needs of the hearing device user. Level and spectrum of sound in function of time is recorded. The data on the environments experienced by the hearing device user is used to improve the final prescription or adjustment of the hearing device. The analysis of logged data and the corresponding fine tuning is done manually or with the aid of a computer.

Generally, the known teachings use only a few sound samples, e.g. one sound sample for each hearing program. In many cases, a sufficient fitting cannot be reached therewith. In addition, the sound samples that have been recorded using data logging often represent a very specific acoustic situation, which does mostly not reflect a common acoustic situation the hearing device user often encounters. In fact, the recorded specific acoustic situation—when used for adjusting the hearing device—leads to imprecise adjustments, which result in non-optimal operation during regular use of the hearing device.

Therefore, it is an object of the present invention to provide an improved method for adjusting hearing devices.

This and other objects are obtained by a method for adjusting a hearing device having a transfer function describing input/output behavior of the hearing device, the method comprising the steps of:

recording a sound signal by an input transducer of the hearing device;

storing at least one of the sound signal and characteristics of the sound signal in a memory unit;

providing a data base comprising at least media samples;

comparing the at least one of the sound signal and its characteristics with at least some of the media samples or characteristics thereof, respectively, to obtain a qualitative measure for at least some of the media samples with respect to the sound signal or its characteristics;

selecting the media sample having the best qualitative measure; and adjusting the transfer function on the basis of the selected media sample.

The method according to the present invention has at least the advantages that an adjustment of a hearing device is more precise and less time consuming than an adjustment using known solutions. Furthermore, the present invention is suitable for extremely large media sample collections and does not depend on subjective verbal reports of the hearing device user. Nevertheless, it is not mandatory to obtain a qualitative measure for each media sample with respect to the sound signal. It is rather proposed, according to the present invention, to obtain a qualitative measure only for those media samples that are suitable for a specific sound signal, i.e. that are likely to be selected for a specific sound signal. Therewith, many media samples are sorted out before its qualitative measures have been determined. As a result, the computational effort is minimized. In addition, very large media sample collections can be handled. Furthermore, the media samples can simultaneously be used by numerous audiologists.

In an embodiment of the present invention, the step of recording the sound signal and the step of storing at least one of the sound signal and its characteristics take place during regular use of the hearing device by a hearing device user. Therewith, real-life situations are used for selecting the most appropriate media sample, which is then used for the adjustment of the transfer function of the hearing device. By using a standardized media sample, any artifacts being mostly incorporated in recorded sound signals are automatically eliminated, which is particularly advantageous because these artifacts often have an unfavorable influence on an adjustment.

In further embodiments of the present invention, the recorded sound signal or its characteristics is/are stored in one or several of the following components:

a memory unit contained in the hearing device;

a local storage unit that is accessible via a calculation unit;

a data base that is accessible via a network;

an external device being accessible by and controlling the hearing device.

Providing a storage unit outside the hearing device has the advantage that a higher storage capacity can be provided because the hearing device only has limited capacity for storage and other components.

In a still further embodiment of the present invention, the media samples are provided by a data base, which is accessible via a network. This bears the advantage that a large, preferably growing media collection can easily be handled. At the same time, the media samples are made available to a large number of audiologists, while the control over who is using the media samples and for what purposes is maintained.

In a further embodiment of the present invention, also characteristics for each media sample are provided, the corresponding characteristics and media sample being linked together. Therewith, the selection of a media sample for a recorded sound signal can be accelerated since the handling of characteristics is easier—i.e. less computational power is needed—than the handling of the entire media sample.

In a still further embodiment of the present invention, the characteristics are based on at least one of the following acoustic parameters:

loudness percentiles;
rate of signal change, zero crossings;
signal dynamic;
speech analyzing;
noise and kind of noise;
pitch, i.e. maximum pitch;
echo;
reverberation.

The qualitative measure is, for example, expressed as the similarity of the signal dynamic of the media sample and of the sound signal. It is pointed out that the qualitative measure may not only be based on a single characteristic, as in the example with the signal dynamic, but can be based on two or more characteristics simultaneously.

In a still further embodiment of the present invention, the method further comprises the step of characterizing the recorded sound signal by a label and linking the label to the corresponding sound signal or its characteristics, the label having influence on the qualitative measure of the respective sound signal or its characteristics. It is pointed out that the influence of the label on the qualitative measure may be so strong that another media sample becomes a better qualitative measure resulting in being selected for the adjustment of the transfer function of the hearing device.

In a further embodiment of the present invention, at least some of the media samples are also characterized by a label. Therewith, not only the sound signal may be labeled but also the media samples, resulting in the possibility to obtain the qualitative measure by comparing the respective labels only, for example, or a pre-selection of possible media samples can be performed to reduce calculations due to the comparison of sound signal and media samples.

In a further embodiment of the present invention, the method further comprises the step of characterizing at least some of the media sample.

The label can be generated manually by the audiologist, for example, or automatically by a hearing device algorithm, for example. Since the label has an influence on the qualitative measure, the most suitable media sample having the best qualitative measure without label may change to another media sample. In fact, the media sample that is selected for adjusting the transfer function of the hearing device may change due to the influence of the label.

More specifically, a label may be one or a combination of the following:

geographic information;
comment by hearing device user;
comment by audiologist;
behavior parameters;
logged sound environment;
keywords and phrases.

In a still further embodiment of the present invention, the behavior parameters of the hearing device comprise at least one of the following:

classifier performance;
classifier behavior;
actuator steering, such as strength of noise canceller;
gain model behavior;
symmetry of hearing devices, in case two hearing devices are used;
position of the hearing device, e.g. from a GPS—(Global Positioning System) that is linked to the hearing device;
acceleration to which a hearing device is exposed.

According to the above-mentioned enumeration, the behavior parameters are not limited to being acoustic-sensory parameters but may also comprise other types of information, as, for example, the position or acceleration.

In a still further embodiment of the present invention, the step of comparing at least one of the sound signal and its characteristics with at least some of the media samples or its characteristics, respectively, to obtain a qualitative measure for at least some of the media samples with respect to the sound signal or its characteristics as well as the step of selecting the media sample having the best qualitative measure are implemented in at least one of the following components:

database;
hearing device;
calculation unit;
external device.

In a still further embodiment of the present invention, the recorded sound signals or its characteristics are directly transmitted to the database via a portable device, such as a mobile phone.

Furthermore, the present invention is directed to a hearing system comprising:

a hearing device comprising an input transducer for recording a sound signal, an output transducer and a signal processing unit having a transfer function describing input/output behavior of the hearing device;
a memory unit for storing at least one of a sound signal and characteristics of the sound signal;
a data base comprising at least media samples;
means for comparing the at least one of the sound signal and its characteristics with at least some of the media samples or characteristics thereof, respectively, to obtain a qualitative measure for at least some of the media samples with respect to the sound signal or its characteristics;
means for selecting the media sample having the best qualitative measure; and
means for adjusting the transfer function on the basis of the selected media sample.

An embodiment of the inventive hearing system comprises the memory unit.

In a further embodiment of the inventive hearing system, the data base is accessible via a network, particularly being the internet.

A further embodiment of the inventive hearing system comprises means for recording the sound signal during regular use of the hearing device by a hearing device user. Accordingly, this embodiment opens up the possibility of taking into account the actual acoustic surrounding the hearing device user is confronted with. The encountered actual acoustic surrounding may be described by characteristics that are calculated from the recorded sound signal and are stored in the memory unit. Therewith, no private acoustic information is stored. The privacy of the hearing device user is not compromised at all.

A further embodiment of the inventive hearing system comprises means for storing the sound signal or its characteristics in one or several of the following components:

a memory unit contained in the hearing device;
a local storage unit that is accessible via a calculation unit, being, for example, a personal computer (PC);
a data base that is accessible via a network;
an external device being accessible by an controlling the hearing device.

A further embodiment of the inventive hearing system comprises a data base with media samples, the data base being accessible via a network.

A further embodiment of the inventive hearing system comprises means for providing at least the media samples by a data base, which is accessible via a network.

In a still further embodiment of the inventive hearing system, the characteristics are based on at least one of the following acoustic parameters:

loudness percentiles;
rate of signal change, zero crossings;
signal dynamic;
speech analyzing;
noise and kind of noise;
pitch, i.e. maximum pitch;
echo;
reverberation.

A further embodiment of the inventive hearing system further comprises means for characterizing the recorded sound signal by a label and linking the label to the corresponding sound signal or its characteristics, the label having influence on the qualitative measure of the respective sound signal or its characteristics.

A still further embodiment of the inventive hearing system comprises means for characterizing at least some of the media samples by a label.

More specifically, a label may be one or a combination of the following:

geographic information;
comment by hearing device user;
comment by audiologist;
behavior parameters;
logged sound environment;
keywords and phrases.

In a still further embodiment of the present invention, the behavior parameters of the hearing device comprise at least one of the following:

classifier performance;
classifier behavior;
actuator steering, such as strength of noise canceller;
gain model behavior;
symmetry of hearing devices, in case two hearing devices are used;
position of the hearing device, e.g. from a GPS—(Global Positioning System) that is linked to the hearing device;
acceleration to which a hearing device is exposed.

According to the above-mentioned enumeration, the behavior parameters are not limited to being acoustic-sensory parameters but may also comprise other types of information, as, for example, the position or acceleration.

In a still further embodiment of the inventive hearing system, the means for comparing at least one of the sound signal and its characteristics with at least some of the media samples or its characteristics, respectively, to obtain a qualitative measure for at least some of the media samples with respect to the sound signal or its characteristics as well as the means for selecting the media sample having the best qualitative measure are implement-able in at least one of the following components:

database;
hearing device;
calculation unit;
external device.

In a still further embodiment of the present invention, the recorded sound signals or its characteristics are directly transmitted to the database via a portable device, such as a mobile phone.

The present invention is further described in detail in the following by referring to exemplified embodiments shown in drawings.

Figure 2:
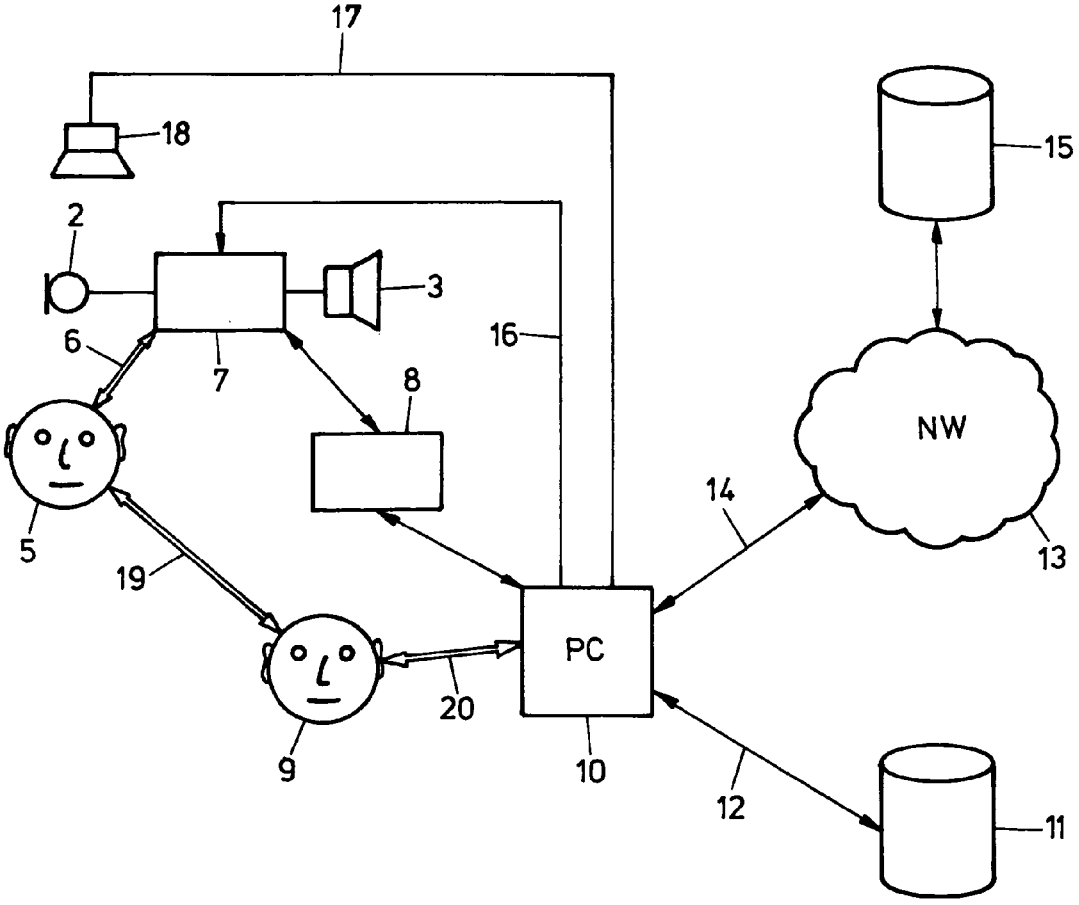

FIG. 1 shows an interaction diagram showing the interactions of a trial use period, during which a hearing device user uses a hearing device in every-day environment, and FIG. 2 shows an interaction diagram showing the interactions of a subsequent fitting session, during which media samples are presented to the hearing device user and during which a fine tuning of the hearing device is performed.

In FIG. 1, an interaction diagram is depicted to illustrate how a hearing device user 5 uses a hearing device 1 in every-day environment. The interaction diagram comprises a hearing device 1 with an input transducer 2, e.g. a microphone, an output transducer 3, also referred to as receiver in the technical field of hearing devices, a signal processing unit 7 and a memory unit 4. In the signal processing unit 7, a transfer functions is implemented describing the input/output behavior, the input being operatively connected to the input transducer 2, and the output being operatively connected to the output transducer 3.

For example, the hearing device 1 is initially fitted based on conventional audiometry. If the hearing device user 5 is dissatisfied with the listening situation, an input unit can be activated, the input unit being, for example, a special button on the hearing device housing, or being a menu point selectable on a menu of a remote control (not shown in FIG. 1). The input unit is labeled, for example, with "tune it", "I don't like it", "get assistance", "log problem", "record for tuning" or the like. Preferably, it is also possible to enter a comment after pushing the input unit in order that the encountered problem, which occurred in connection with the activation of the input unit, can be described, as for example "can't understand my grandchildren" or "fridge noise is annoying". The comment can be designated as "label", more specifically as "human label", and can be entered via a keypad, e.g. similar to entering a text on a mobile phone for a SMS—(Short Message Service). In other embodiments, the comment is selected from a menu, or the comment is directly recorded in the hearing device as a voice message. Once the input unit has been activated by the hearing device user 5, the hearing device 1 logs data regarding the current listening situation, for example, for the next 30 seconds.

In a further embodiment of the present invention, the hearing device 1 comprises a memory unit 4 with a cyclic memory such that it is possible to log also a certain time span before the input unit is activated.

Although the memory unit 4 of FIG. 1 is shown outside the hearing device 1, the memory unit 4 is, in one embodiment of the present invention, incorporated into the hearing device 1. Data is then directly logged into an internal memory of the hearing device 1.

In a further embodiment of the present invention, the memory unit 4 is incorporated into an external device, such as a remote control, any other hands-free device or a smart phone that is connectable to the hearing device 1. The connection between the hearing device 1 and the memory unit 4 is a bidirectional connection and either is a wire-less or a wired connection.

An external data logging device has the advantage that it can be temporarily borrowed to the hearing device user 5 during the trial or acclimatization phase. Thereby, the feature becomes available to hearing device users 5 who cannot afford a hearing device with extended memory and/or external device.

In a still further embodiment of the present invention, the sound environment is logged directly (e.g. wav-file) such that no sound analysis needs to be performed before logging data.

In another embodiment of the present invention, only results of an analysis of a recorded sound signal are logged in the memory unit 4. Logging results of an analysis—also called characteristics—has the advantage that the privacy of the conversations of the hearing device user is maintained, and that far less memory resources are needed. This is especially important if logging should be active the whole time and not only upon certain events.

Analyzing the sound signal can be done in different ways. It has been shown that one or more of the following analysis of the recorded sound signal is favorable:

determining of loudness percentiles (e.g. 35, 65, 95);
determining of rate of signal change or zero crossings;
determining of dynamic range of the sound signal;
performing speech analysis;
determining of noise, including kind of noise;
determining of pitch, in particular of maximum pitch;
determining of echo;
determining of reverberation.

In a further embodiment of the present invention, one or several of the following data regarding the hearing device behavior can be logged in combination with any embodiment described above or below:

classifier performance;
classifier behavior;
actuator steering strength, such as strength of a noise canceller;
gain model behavior;
symmetry of hearing devices if two hearing devices are present, such as for a binaural hearing system.

In FIG. 2, an activation diagram is depicted to illustrate how the hearing device 1 is adjusted in a fitting session, normally being subsequent to a trial use period, as has been described in connection with FIG. 1.

It is noted that the same reference sign have been used in FIG. 2 for the same elements as have already been introduced in FIG. 1. Accordingly, the hearing device 1 with its components, namely the input transducer 2, the signal processing unit 7 and the output transducer 3, as well as the hearing device user 5 are represented. The memory unit 4 (FIG. 1) is not explicitly shown. Nevertheless, a memory unit for storing logged data is incorporated into the signal processing unit 7, for example.

FIG. 2 further shows an external device—such as a remote control—, a calculation unit 10—such as a personal computer (PC)—and a loudspeaker unit 18. The external device 8 is operatively connected to the hearing device 1 as well as to the calculation unit 10, which is controlled by an audiologist 9 via a keyboard or other input devices. The loudspeaker unit 18 is operatively connected via a wire 17 to the calculation unit 10 in order to provide selected sound samples (so called media samples) to the input transducer unit 2 of the hearing device 1.

The calculation unit 10 is further operatively connected to a local storage unit 11 via internal connection 12. In addition, an external data base 15 is operatively connected via connection 14 and network 13 to the calculation unit 10, the network 13 being, for example, the internet.

The external database 15 contains, for example, thousands of audio and/or video files, which are also referred to as "media samples" in the following. The media samples can be divided in sequences, whereas each media sample and/or sequence is labeled specifying physical characteristics and/or labels reflecting, for example, the reaction of the hearing device or its user to the media sample. In addition, manually entered descriptions or keywords may also be available for a media sample or sequence. Therefore, the manually entered description or the keywords are also referred to as a "human label", but the term label is also used throughout this application. Examples for such labels are "child voice", "male talker" and "restaurant". The aim of labels is to describe the scenery, to list all sound sources (e.g. foreground and background) and to identify what possible hearing targets could be. Labels can also contain geographic and language information.

The automatic labeling uses preferably the same or similar algorithms as are used for sound analysis in the hearing device 1. In further embodiments, it can also be envisioned that media samples are presented to a hearing device during the labeling process.

As has been already described above, the embodiment depicted in FIG. 2 comprises a local storage unit 11 as well as the data base 15. It is pointed out that further embodiments comprise either one of the two, the one being present containing the media samples. Therefore, in the embodiment only comprising the local storage unit 11, no network connection is necessary, bearing the advantage that a fast access to the media samples is guaranteed.

On the other hand, a database 15, i.e. the online solution, has the advantage that updates of the database via other channels are immediately available to all audiologists having access to the database 15, and it is possible to acquire statistical data regarding the usage of the database. In particular, it is possible to count how often a media sample has been used, i.e. how many times it has been downloaded from the database 15. Media samples, which have often been used, could be used for validation purposes or for hearing performance profiling (HPP) to qualify the sound of future devices in order to use these results for a benchmark test. In a further embodiment of the present invention, it is the aim to create or produce more or more specific media samples with labels to match more accurately the needs of the hearing device user and the needs of the audiologist. The labels also help to determine the typical or main hearing problems of a hearing device user. Further, the information regarding the problems and/or labels which cause problems can help to develop a better pro-active adjustment of the hearing device.

As has already been pointed out, the information comprised in the database 15 is, in a particular embodiment, mainly or fully installed or stored in the local storage unit 11, e.g. on a hard disc of a PC of the audiologist. This is feasible because large data storage devices are increasingly available at a low price. The information stored in the database 15 would be downloaded once, or an external hard disk could be sent to the audiologist (or to the hearing device user). The local storage unit 11 comprising the information of the database 15 has the advantage that the audiologist can also work offline and that accessing the information is somewhat faster. It would still be possible to connect to a central server or to the database 15 in order to download database updates and to upload statistical information. In further embodiments of the present invention, it is proposed to keep the labels in the database 15 and the media samples locally, i.e. in the local storage unit 11, or vice versa.

In the following, the procedure for adjusting a hearing device may be summarized as follows:

During a first session, the audiologist explains the features to the hearing device user and, if necessary, hands out an additional, temporary external device, such as the above-mentioned external device 8.

After the first session, the hearing device user uses the hearing device and records sound signals in the manner explained by the audiologist. These recorded sound signals form the basis—together with additional information, as for example the above-mentioned labels—for a second session.

In the second session, the audiologist connects the hearing device 1 and/or the external device 8 to the calculation unit containing a counseling software tool for audiologists. The connection between these devices is implemented, for example, with Bluetooth, USB and/or W-LAN. The logged data is then imported and either stored in the local storage unit 11 or in the database 15. Preferably, the audiologist also interviews the hearing device user about difficult hearing situations and enters significant keywords or phrases describing these situations. Then the logged data and the keywords, i.e. the recorded sound signals and/or characteristics and/or labels, are transmitted, if not already done, to the database 15. Certain keywords, such as geographic location and language may be added automatically. If necessary, the logged data is analyzed in the database 15 or in the calculation unit 10. Afterwards, the sound characteristics and, if applicable, the labels of the logged sound environment are compared with the media samples and/or its labels stored in the database 15. As a result of the comparison, a hit-list is generated, which comprises, for example, the ten most similar media samples from the database 15. Google or iTunes are examples for how a hit-list can be designed.

As indicated above, the media samples may also be linked to a label further describing the content of the media sample. This can be done in a similar or identical manner as has been applied to the recorded sound signal. Therewith, a pre-selection of media samples can be performed, for example, based on labels assigned to a specific sound signal.

The analysis of the sound signal recorded by the input transducer 2 is completely performed in one entity or is distributed among the entities. More specifically, the analysis of the sound signal recorded by the input transducer 2 can be done by at least one of the following device:

the hearing device 1;
the external device 8 (if applicable);
the calculation unit 10;
the database 15.

It is pointed out that the database 15 is not only a device to store information, but any calculation may also be performed. Therefore, the database 15 can also referred to as server in the sense of common network terminology.

Performing the analysis of the sound signal recorded by the input transducer 2 early has the advantages of a better privacy protection, of reduced logging memory and of reduced communication bandwidth requirements. Performing the analysis later, for example in the database 15, has the advantage of maintaining more options regarding the algorithms used, and of providing a more meaningful basis for statistical analysis.

When compiling the hit-list, different criteria can be applied: For example, good matches of hearing device behavior and/or audio signal character, or good matches regarding the label. The main objective of providing the media sample is replaying it to the hearing device user wearing the hearing device and manually fine tuning the adjustment of the transfer function in regard to the selected media sample. However, it is also possible to use the media sample and/or its labels for an automatic adjustment. E.g. if many sets of sound signals have been recorded or selected with car noise or traffic noise, the noise canceller strength could be increased automatically. A supplementary input by the audiologist (or the hearing device user) to improve the solution of this problem in regard to this specific media sample, such as "echo mask speech", would allow more complex (semi-) automatic adjustments of the hearing device.

Further, the database can also be used as a universal counseling tool due to the labeling, no matter which hearing device or hearing device brand is used.

In another embodiment of the present invention, the logged data is directly transmitted to the database, for example by a smart-phone using GPRS (general packet radio service). The database 15 uses the received information to determine suitable real-life fitting media samples and sends them to the audiologist in good time before the next fitting session. Such an embodiment has the advantage that there are no delays during the fitting process that could occur due to network- or database-resources that are slow or out of service.

In a further embodiment of the present invention, if the number of difficult logged hearing situations is high—or if the patient has pushed "tune it" many times—multiple situations can be combined to determine a combined optimum media sample to be used during fitting.

In some situations, it can also be beneficial to activate the logging feature during the fitting session. For example a musician may play his instrument. It is then possible to retrieve media samples from the database which contain the same or a similar type of instrument with different background sounds. Therewith, the transfer function of the hearing device 1 can be adjusted to more acoustic situations as are available from the recorded sound signal.

The invention claimed is:

1. A method for fitting a hearing device having a transfer function describing an input/output behavior of the hearing device, the method comprising the steps of:

during regular operation of the hearing device, recording a sound signal by an input transducer of the hearing device;

during regular operation of the hearing device, storing at least one of the sound signal and characteristics of the sound signal in a memory unit, for later use during a fitting session;

providing a data base comprising at least media samples;

during the fitting session, comparing the at least one of the sound signal and the characteristics of the sound signal with at least some of the media samples or characteristics thereof, respectively, to obtain a qualitative measure for at least some of the media samples with respect to the sound signal or the characteristics of the sound signal;

during the fitting session, selecting the media sample having the best qualitative measure; and during the fitting session, adjusting the transfer function based on the selected media sample, thereby fitting the hearing device, wherein the media samples are used in association with the hearing device only during the fitting session and not during the regular operation of the hearing device.

2. The method of claim 1, wherein the step of recording the sound signal and the step of storing at least one of the sound signal and the characteristics of the sound signal take place during regular use of the hearing device by a hearing device user.

3. The method of claim 1, wherein the recorded sound signal and/or the characteristics of the sound signal is/are stored in one or several of the following components:

the memory unit contained in the hearing device;
a local storage unit that is accessible via a calculation unit;
the data base, which is accessible via a network; and
an external device being accessible by and controlling the hearing device.

4. The method of claim 1, wherein at least the media samples are provided by the data base, which is accessible via a network.

5. The method of claim 1, wherein characteristics for each media sample are provided, corresponding characteristics and media sample being linked together.

6. The method of claim 1, wherein the characteristics of the sound signal and/or the media samples are based on at least one of the following acoustic parameters:

loudness percentiles;
a rate of signal change or zero crossings;
a signal dynamic;
speech analysis;
noise and kind of noise;
pitch;
echo; and
reverberation.

7. The method of claim 1, further comprising the step of characterizing the recorded sound signal by a label and linking the label to the corresponding sound signal or the characteristics of the sound signal, the label having influence on the qualitative measure of the corresponding sound signal or the characteristics of the sound signal.

8. The method of claim 7, wherein at least some of the media samples are characterized by a label.

9. The method of claim 7, wherein the label is defined by at least one of the following:

geographic information;
a comment by a hearing device user;
a comment by an audiologist;
behavior parameters;
a logged sound environment; and
keywords and phrases.

10. The method of claim 9, wherein the behavior parameters of the hearing device are at least one of the following:

classifier performance;
classifier behavior;
actuator steering;
gain model behavior;
a symmetry of hearing devices, in case two hearing devices are used;
a position of the hearing device; and
acceleration to which the hearing device is exposed.

11. The method of claim 1, wherein the step of comparing at least one of the sound signal and the characteristics of the sound signal with at least some of the media samples or the characteristics of the media samples, respectively, to obtain the qualitative measure for at least some of the media samples with respect to the sound signal or the characteristics of the sound signal as well as the step of selecting the media sample having the best qualitative measure are implemented in at least one of the following components:

the data base;
the hearing device;
a calculation unit; and
an external device.

12. The method of claim 1, wherein the recorded sound signals are directly transmitted to the data base via a portable device.

13. A hearing system comprising:

a hearing device comprising an input transducer for recording a sound signal during regular operation of the hearing device, an output transducer and a signal processing unit having a transfer function describing an input/output behavior of the hearing device;

a memory unit for storing, during regular operation of the hearing device, at least one of a sound signal and characteristics of the sound signal for later use during a fitting session;

a data base comprising at least media samples;

characterized by means for comparing, during the fitting session, the at least one of the sound signal and the characteristics of the sound signal with at least some of the media samples or characteristics thereof, respectively, to obtain a qualitative measure for at least some of the media samples with respect to the sound signal or the characteristics of the sound signal;

means for selecting, during the fitting session, the media sample having the best qualitative measure; and means for adjusting, during the fitting session, the transfer function based on the selected media sample, thereby fitting the hearing device, wherein the media samples are used in association with the hearing device only during the fitting session and not during the regular operation of the hearing device.

14. The hearing system of claim 13, characterized in that the hearing device comprises the memory unit.

15. The hearing system of claim 13, characterized in that the data base is accessible via a network.

16. The hearing system of claim 13, characterized by means for characterizing the recorded sound signal by a label and linking the label to the corresponding sound signal, the label having influence on the qualitative measure of the corresponding sound signal or the characteristics of the sound signal.

17. The method of claim 12, wherein the portable device is a mobile phone.

18. The hearing system of claim 15, wherein the network comprises the Internet.

19. The method of claim 1, wherein the media samples comprise at least one of audio files and video files.

20. The hearing system of claim 13, wherein the media samples comprise at least one of audio files and video files.

* * * * *